US006009943A

United States Patent [19]

Yokley et al.

[11] Patent Number: 6,009,943

[45] Date of Patent: Jan. 4, 2000

[54] LINER ASSEMBLY AND METHOD

[75] Inventors: John M. Yokley, Richmond; James A. Simson, Stafford; Mark J. Murray, Sugar Land, all of Tex.; Robert R. Olman, Washington, La.

[73] Assignee: Smith International, Inc., Houston, Tex.

[21] Appl. No.: 09/219,293

[22] Filed: Dec. 22, 1998

Related U.S. Application Data

[62] Division of application No. 08/782,425, Jan. 14, 1997, Pat. No. 5,884,702

[60] Provisional application No. 60/012,669, Mar. 1, 1996.

[51] Int. Cl.[7] ..... E21B 23/06

[52] U.S. Cl. ..... 166/125; 166/123; 166/181

[58] Field of Search ..... 166/123, 124, 166/125, 181, 182, 386, 387

[56] References Cited

U.S. PATENT DOCUMENTS

| | | | |
|---|---|---|---|
| 3,677,341 | 7/1972 | Burns et al. | 166/124 |
| 4,237,979 | 12/1980 | Weise | 166/123 X |
| 4,712,614 | 12/1987 | Allwin et al. | 166/208 |
| 4,830,103 | 5/1989 | Blackwell et al. | 166/387 |
| 5,553,672 | 9/1996 | Smith, Jr. et al. | 166/123 X |
| 5,690,172 | 11/1997 | Westra | 166/123 |

*Primary Examiner*—George Suchfield
*Attorney, Agent, or Firm*—Conley, Rose & Tayon, P.C.

[57] ABSTRACT

The liner assembly and method includes lowering a liner, liner hanger, liner hanger setting tool, liner packer, and liner packer setting tool into the borehole on a work string. The liner hanger is set either hydraulically or mechanically using the liner hanger setting tool at the option of the operator. The liner is then cemented within the borehole and the liner packer setting tool is used to set the liner packer either hydraulically or mechanically at the option of the operator. The liner packer setting tool includes an actuator assembly mounted on the exterior of a tubular body. The actuator assembly includes an actuator member having a contact member which engages the packing element on the liner packer such that upon movement of the contact member with respect to the liner packer, the packing element on the liner packer is compressed to sealingly engage the cased borehole. The actuator member is sealed from the fluid pressure within the borehole until the liner packer is to be set. The contact member may be actuated either mechanically or hydraulically or may be actuated hydraulically and mechanically.

16 Claims, 7 Drawing Sheets

LINER ASSEMBLY AND METHOD

CROSS-REFERENCE TO RELATED APPLICATION

The present application is a divisional of Ser. No. 08/782,425 filed Jan. 14, 1997 now U.S. Pat. No. 5,884,702 and entitled Liner Assembly and Method which claims the benefit of 35 U.S.C. 111(b) provisional application Ser. No. 60/012,669 filed Mar. 1, 1996 and entitled Liner Assembly and Method both incorporated herein by reference.

BACKGROUND OF THE INVENTION

The present invention relates to a method and apparatus for suspending, cementing and packing off a liner within a well, and more particularly to a one trip liner hanger and packer, and still more particularly to a setting tool for setting the packer within the well, and most particularly to setting the packer by hydraulic and/or mechanical means and releasing the setting tool from the packer.

Typically, in the drilling of a well, a borehole is drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. Generally, this is repeated until a plurality of concentric casings are suspended and cemented within the well to a depth which causes the well to extend through one or more hydrocarbon producing formations.

Oftentimes, rather than suspending a concentric casing from the bottom of the borehole to the surface, a liner may be suspended either adjacent the lower end of a previously suspended and cemented casing or from a previously suspended and cemented liner. The liner extends from the previously set casing or liner to the bottom of the new borehole. A liner is casing which is not run to the surface. A liner hanger is used to suspend the liner within the lower end of the previously set casing or liner. Typically, the liner hanger has the ability to receive a tie back tool for connecting the liner with a string of casing which extends from the liner hanger back to the surface. Liners may be used for both land and offshore wells.

A setting tool disposed on the lower end of a work string is releasably connected to the liner hanger which is attached to the top of the liner. The work string lowers the liner hanger and liner into the open borehole extending below the lower end of the previously set casing or liner. The borehole is filled with fluids such as drilling mud which flows around the liner and liner hanger as the liner is run into the borehole. The assembly is run into the well until the liner hanger is adjacent the lower end of the previously set casing or liner and the lower end of the liner is above the bottom of the open borehole. As can be appreciated, it is desirable to have the inside diameter of the liner be as large as possible to allow more space for additional liners to be disposed within the well.

When the liner reaches the desired location relative to the bottom of the open borehole and the previously set casing or liner, a mechanism in the setting tool is actuated to move slips on the liner hanger from a retracted position to an expanded position into engagement with the previously set casing or liner. Thereafter, when weight is applied to the hanger slips, the slips are set to support the liner.

The liner hanger setting tool may be actuated either hydraulically, or mechanically.

See U.S. Pat. No. 4,712,614. The setting tool can have a hydraulically operated setting mechanism for the hanger slips or can have a mechanically operated setting mechanism for the setting slips. A hydraulically operated setting mechanism typically employs a hydraulic cylinder which is actuated by pressure in the bore of the work string. In mechanically setting the liner hanger, it is usually necessary to obtain a relative downhole rotation of parts between the setting tool and liner hanger to release the hanger slips. The hanger slips are then one-way acting in that the hanger and liner can be raised or lifted upwardly but a downward motion of the liner sets the slips to support the hanger and liner within the well.

Then to release the hanger, the setting tool is lowered with respect to the liner hanger and rotated to release a running nut on the setting tool from the liner hanger. Cement is then pumped down the flowbore of the work string and liner and up the annulus formed by the liner and open borehole. Before the cement sets, the liner hanger setting tool and work string are removed from the borehole. In the event of a bad cement job, a liner packer and liner packer setting tool are then attached to the work string and lowered back into the borehole. The packer is set utilizing the liner packer setting tool.

Packers for liners are often called liner isolation packers. A typical liner top isolation packer system includes a packer element mounted on a mandrel. A seal nipple is disposed below the mandrel which stings into a tie back receptacle on top of or below the liner hanger. A liner isolation packer is used to seal the liner in the event of a bad cement job. Typically, the liner isolation packer is set down on top of the hanger and the packer is set by a setting, tool to form a seal of the annulus between the liner and the previously set casing or liner.

Another problem occurs if the cement extends over the top of the liner before the packer is run into the well. If that occurs, it is necessary that the operator run into the well and remove all cement from the sealing receptacle of the liner hanger which receives the packer.

The above process requires additional trips into the well. It is preferred to eliminate these additional trips. This requires that the packer and packer setting tool be lowered into the well with the liner hanger and liner. By having a single trip operation, the potential of damaging the formation during the additional trips into the hole are avoided. In a one trip system, the hanger and packer are run into the wellbore together until the desired location is reached. The hanger is then set and the setting tool nut is disengaged from the hanger. The setting tool is supported by the work string with a sealing device in the bore of the liner hanger so that there is a continuous bore from the earth's surface to the lower end of the liner. When cement is pumped through the continuous bore formed by the work string, liner, and cementing equipment, the cement is displaced up the annulus between the liner and open borehole. Following the cementing of the liner in the borehole, the liner packer is set and the liner hanger and packer setting tools are retrieved and the drilling or completion operation continued.

Some prior art systems do not separate the packer setting mechanism from the hanger setting mechanism. Thus, the packer may be set prematurely in attempting to set the liner hanger.

Prior art combination setting tools must be concerned about the passage of pressures into the setting tool which would either set the packer or release the liner hanger. One trip systems typically rely upon stacked shear pressures for hydraulically setting the liner hanger and packer or a separate dog section for mechanically setting the liner packer. Setting tools that rely upon stacked shear pressures to sequentially set the hanger, cement, and then set the packer, are subject to pressure surges or spikes that can prematurely set the packer. Also, hydraulically set equipment often requires that shearing take place and sometimes the shear mechanism shears prematurely or won't shear at all. Further, a separate dog section for mechanically setting the packer is not as effective in horizontal wells since limited set down weight can be applied to the dogs. Prior art combination setting tools limit the variety of operations to set the liner hanger due to the possibility of also setting the packer prematurely.

In deep wells, most liner hangers and packers are set hydraulically rather than mechanically. Particularly if the mechanical set requires a rotation of the work string. In deep wells, it is difficult to rotate the lower end of the work string because of its length. Further, even if the work string is rotated, the operator may be unsure whether that rotation was translated to the liner hanger, packer or work string.

Many prior art liner hangers, packers and setting tools do not allow the operator to have the option to either set hydraulically or mechanically. Further, those systems that allow both hydraulic and mechanical operation require a particular sequence of operation such that the system will allow the liner hanger to be set mechanically and then allow the packer to be set hydraulically.

The present invention overcomes the deficiencies of the prior art.

SUMMARY OF THE INVENTION

The liner assembly and method includes a liner hanger and packer that sets a liner suspended by a work string. The setting tool includes an actuator assembly mounted on the exterior of a tubular member. The actuator assembly includes an actuator member having a contact member which engages a movable sleeve on the packer such that upon the movement of the contact member with respect to the packer, the movable sleeve compresses the packing element on the packer to cause the packer to sealingly engage the cased borehole. The actuator member is sealed from the fluid pressure within the work string flowbore until the packer is to be set. The contact member may be actuated either mechanically or hydraulically at the option of the operator.

To operate the liner packer setting tool hydraulically, an aperture is provided through the wall of the tubular member. A closure member is slidingly received over the tubular member and has an open position for allowing flow through the aperture and a closed position for preventing flow through the aperture. Initially, the closure member is in the closed position. The actuator member is releasably supported in the packer by retractable dogs. The contact member is slidingly disposed on the actuator member with the actuator member and contact member forming a cylinder. Upon the closure member moving to the open position and registering the aperture within the cylinder, the pressure within the work string flowbore actuates the contact member causing it to move with respect to the actuator member and compress the packing element on the packer.

The liner packer setting tool may also be actuated mechanically. Upon registering the aperture with the cylinder, the closure member includes ratchet teeth which allow the contact member to move downwardly with respect to the tubular member but not allow the tubular member to move downwardly with respect to the contact member such that upon placing weight on the work string, weight is transferred from the tubular member to the closure sleeve which is connected to the contact member so as to cause the contact member to apply a compressive force on the packing element and set the packer.

After either setting method, the setting tool can be released from the packer by either rotational means or by straight pull at the option of the operator.

The method includes lowering a liner, liner hanger, liner hanger setting tool, packer and packer setting tool into the borehole on a work string. The liner hanger is hydraulically or mechanically set at the option of the operator using the liner hanger setting tool. The liner is then cemented within the borehole. The packer is set either hydraulically or mechanically at the option of the operator using the liner packer setting tool.

Other objects and advantages of the present invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
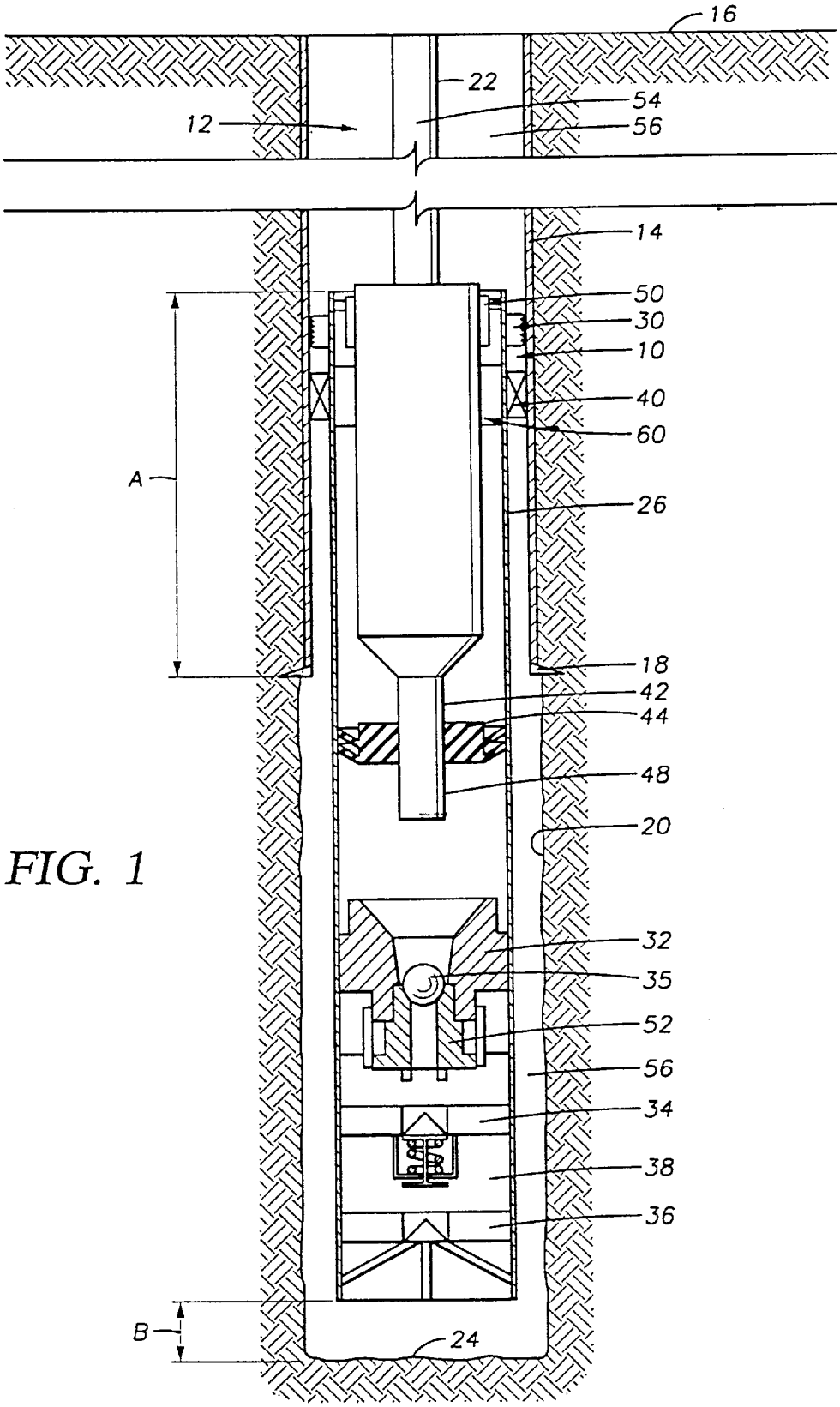
FIG. 1 is a diagram of a cross-sectional elevation view of a well in which is suspended the liner assembly of the present invention.

Referring initially to FIG. 1, the liner assembly 10 of the present invention is shown suspended within a well 12. The well 12 includes an outer casing 14 extending from the surface 16 down into the well 12 with its lower end cemented at 18. Outer casing 14 may be a previously set string of casing. After outer casing 14 has been cemented, the well is drilled deeper forming borehole 20. The liner assembly 10 is lowered through outer casing 14 and into borehole 20 by means of a work string 22. The top of the liner assembly 10 is suspended within the lower end of outer casing 14 so as to overlap outer casing 14. The lower end of liner assembly 10 is typically suspended off the bottom 24 of borehole 20.

The liner assembly 10 includes a liner hanger 30 and a packer 40 below which is suspended a pipe string forming the liner 26 for borehole 20. Mounted on the lower end of liner 26 is a landing collar 32, a float collar 34, and a shoe 36. Collar 34 and shoe 36 form a one-way valve which prevents the upward flow of fluids through liner 26. Disposed within liner 26, is a pocket slip setting tool 50 and a packer setting tool 60 below which extends one or more slick joints 42. At the lower end 48 of slick joints 42 is a wiper member 44. The landing collar 32 provides a shear member 52 which receives a ball 35. Collar 32 also has a threaded receptacle to latch and lock wiper 44. The setting tools 50 and 60, liner 26 and work string 22, form a vertical flowbore 54 extending to the surface 16 for the passage of drilling fluids and cement. Likewise, liner 26 and work string 22 form an annulus 56 with borehole 20 and outer casing string 14 which extends to the surface 16. The annulus 56 extends from the surface 16 down to shoe 36 adjacent borehole bottom 24. Flowbore 54 and annulus 56 provide a flow path for drilling fluids and cement for the cementing operation to cement liner 26 within borehole 20, as hereinafter described in further detail.

Liner Packer

Figure 2A:
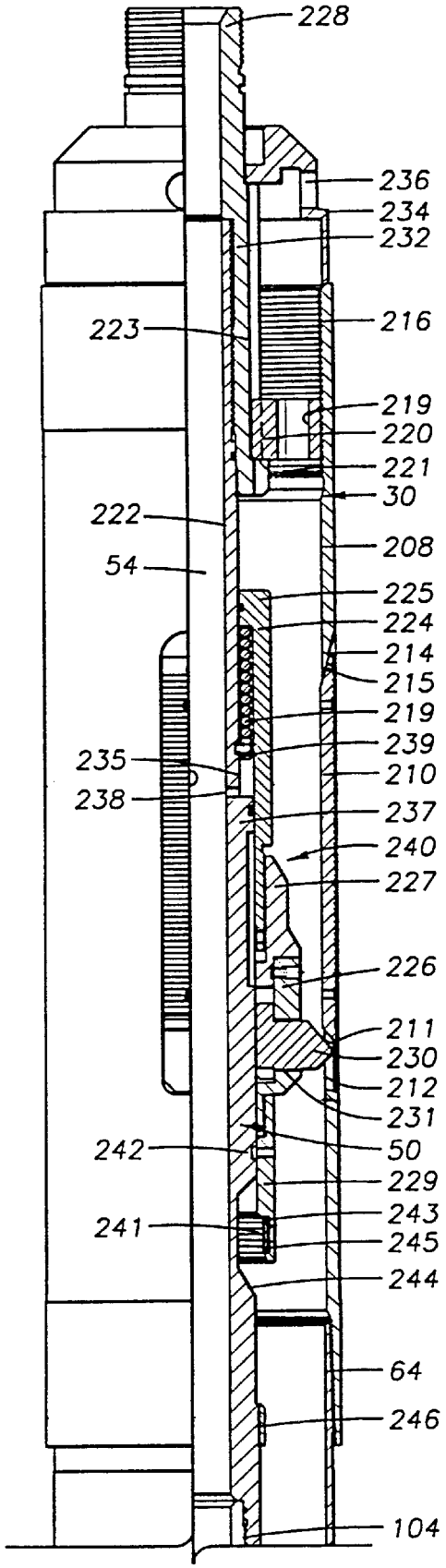
FIGS. 2A–2C are a cross-sectional elevation view of the liner hanger, liner packer and the setting tools for the liner hanger and liner packer shown diagrammatically in FIG. 1.
Figure 2B:
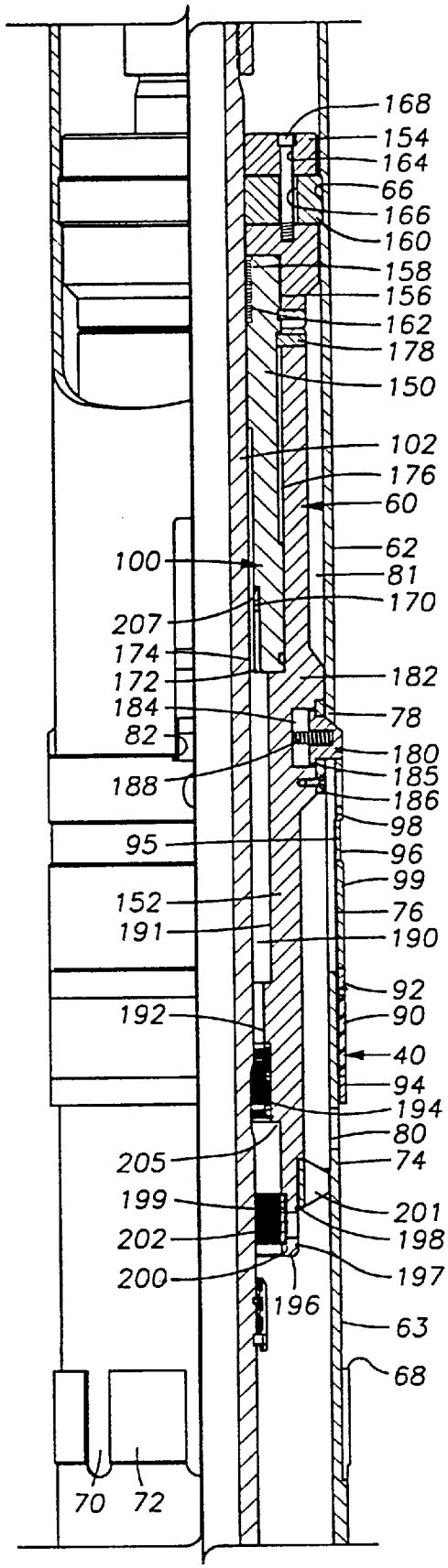
Figure 2C:
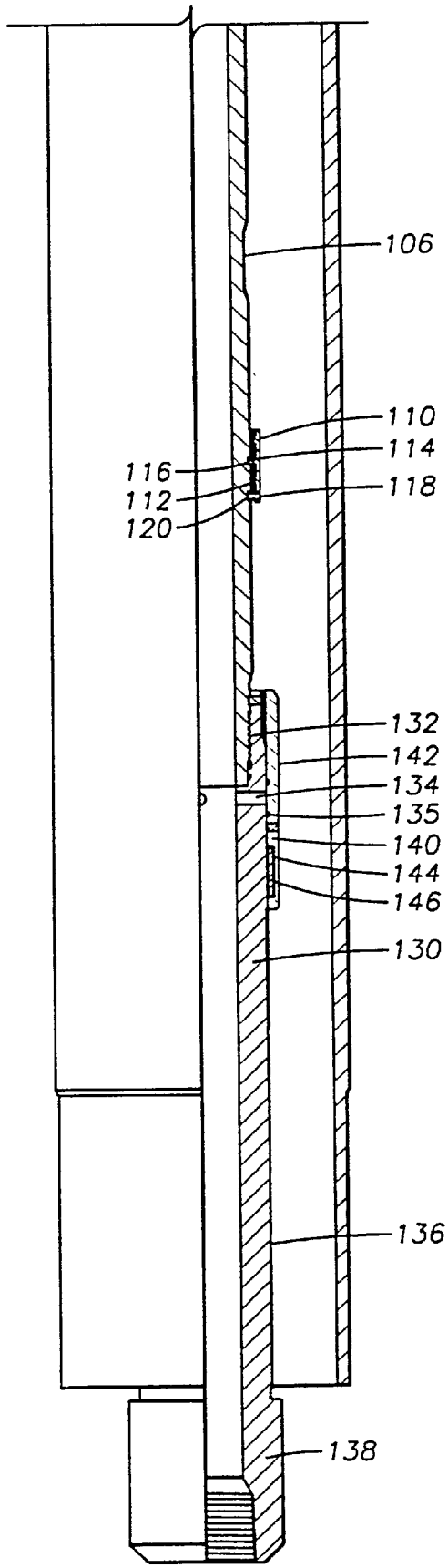

Referring now to FIGS. 2A–C, liner packer 40 is disposed on liner assembly 10 (shown in FIG. 1) below liner hanger 30. Liner packer 40 includes a tubular member 62 having threads 64 at its upper end for threaded engagement with the lower end of pocket slip liner hanger 30. An inner annular latch groove 66 is provided adjacent the upper end of tubular member 62 and is adapted for receiving a plurality of latches 160 on packer setting tool 60, hereinafter described in detail. The upper portion of tubular member 62 has a reduced outer diameter 63. A plurality of arcuate members 72 are provided around the circumference of tubular member 62 at the change in diameter of member 62 to form a plurality of upwardly facing shoulders 68. Bypass slots 70 are provided between arcuate members 72 for the passage of well fluids and cement, as hereinafter described in further detail. Above and adjacent to shoulders 68 are a plurality of cement bypass ports 80 for the passage of well fluids and cement as hereinafter described in further detail. Above bypass ports 80 is disposed a packing element 90 having an upper and lower compression ring 92, 94, respectively, which are positioned around a seal bore 74 on reduced diameter 63. One preferred packing element 90 is the ABC Packing Element manufactured by CDI Seals Incorporated. Above the upper compression ring 94 is a spacer ring 99 and a ratchet ring 96. Ratchet ring 96 has inwardly extending annular ratchet teeth 95 which are in engagement with ratchet teeth 76 around the outer circumference of tubular member 62 above bypass ports 80. A spacer and retainer ring 98 is disposed between ratchet ring 96 and dogs 180. The teeth 95 of ratchet ring 96 and the ratchet teeth 76 on tubular member 62 allow ratchet ring 96 to move downwardly while preventing the upward movement of packing element 90. A plurality of longitudinally extending apertures 78 are azimuthally spaced around tubular member 62 for receiving retractable setting dogs 180 on packer setting tool 60, as hereinafter described in further detail. A spacer and retainer ring 98 is provided above ratchet ring 96 which is notched at 82 for dogs 180. Filed concurrently herewith is U.S. patent application Ser. No. 08/782,416, filed Jan. 14, 1997, now U.S. Pat. No. 5,884,702, and entitled "Liner Packer Assembly and Method", Attorney File 1030-07400 incorporated herein by reference. It should be appreciated that conventional types of liner packers may be utilized such as with the model Weight Set Packer Element manufactured by Smith International.

Packer Setting Tool

Figure 3:
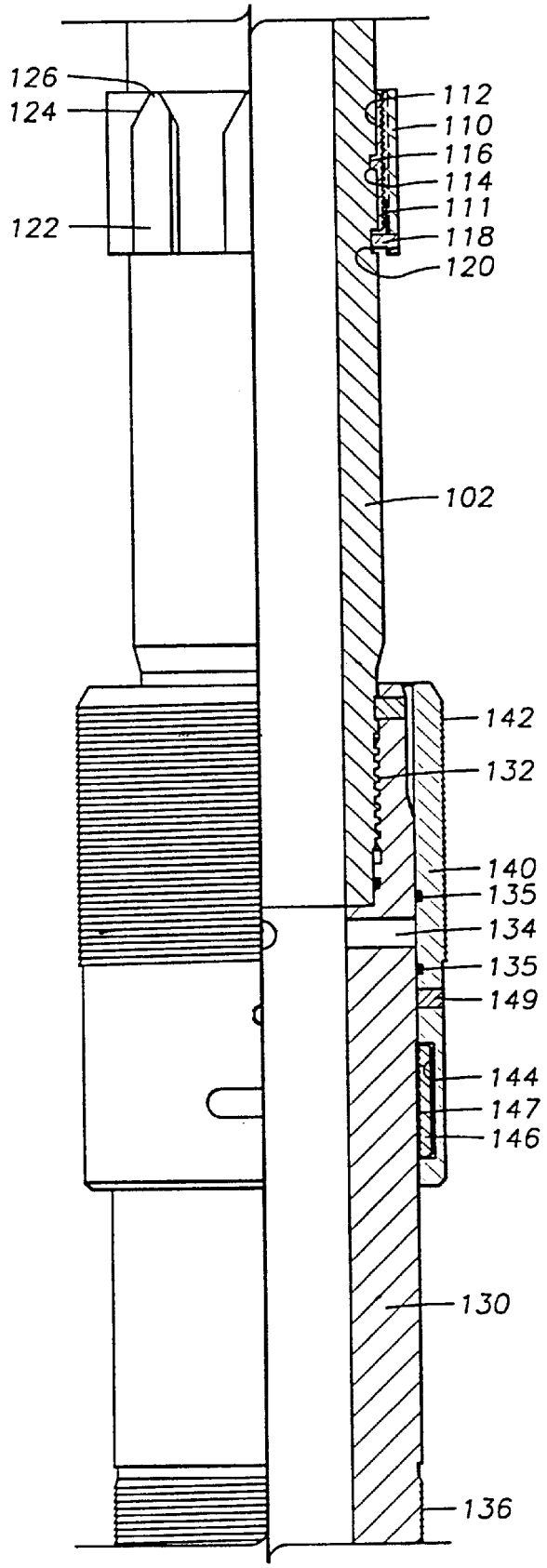
FIG. 3 is a cross-sectional elevation view of the release nut and ratchet sleeve on the lower end of the packer setting tool.

Referring now to FIGS. 2A, 2B, 2C and 3, packer setting tool 60 is shown disposed below pocket slip setting tool 50. Packer setting tool 60 includes a packer actuator and setting assembly 100 disposed around an inner mandrel 102 having threads 104 at its upper end for threaded engagement to the lower end of pocket slip setting tool 50. Packer setting tool mandrel 102 includes an outer annular dog release groove 106 disposed below packer setting assembly 100. A release nut 110 is mounted on mandrel 102 below release groove 106. Release nut 110 includes an inner threaded split ring 112 having outer threads which threadingly engage at 111 internal threads on release nut 110. Threaded split ring 112 includes an inwardly directed flange member 114 which is received within a notch 116 in mandrel 102 to prevent split ring 112 from rotating with respect to mandrel 102. The release nut 110 is also disposed on mandrel 102 by means of a shear screw 118 which extends into a blind hole 120 in mandrel 102. As best shown in FIG. 3, release nut 110 includes a plurality of longitudinally extending splines 122 disposed azimuthally around the outer circumference of release nut 110. The upper terminal end of splines 122 is beveled at 124 and 126 for guiding release nut 110 into spline nut 172, as hereinafter described in further detail.

A lower mandrel 130 is threaded at 132 to the lower end of inner mandrel 102. A port 134 extends through the wall of the upper end of lower mandrel 130 just below threads 132. Ratchet threads 136 are provided around the circumferential lower surface of lower mandrel 130. The terminal end 138 of lower mandrel 130 is connected to slick joints 42. A ratchet sleeve 140 is mounted around the upper end of lower mandrel 130. Annular sealing members 135, such as O-rings, are housed in grooves in sleeve 140 for initially sealing off port 134. Sleeve 140 includes external upper ratchet threads 142 adapted for engagement with split ratchet ring 200 of packer setting assembly 100, as hereinafter described in further detail. A drag pin 149 is provided in the wall of sleeve 140 for engaging the external surface of lower mandrel 130. Sleeve 140 includes a lower inwardly facing annular groove 144 in which is mounted a lower split ratchet ring 146 having internal ratchet teeth 147 adapted for engagement with ratchet threads 136 disposed therebelow on mandrel 130.

Referring now to FIG. 2B, packer setting apparatus 100 includes a body 150 and an actuator member or piston 152. Body 150 includes a latch retainer 154 threaded at 156 to its upper end. Retainer 154 and body 150 form ant inner annular groove 158 for housing a packing seal 162 which sealingly engages the external surface of inner mandrel 102. Retainer 154 includes a plurality of apertures 164 housing retractable dogs or latches 160 which are received within latch groove 66 for supporting packer setting apparatus 100 on hanger setting tool 50. Latches 160 include a longitudinal bore 166 adapted for receiving threaded guide pins 168 for attaching latches 160 to retainer 154 while allowing latches 160 to move radially within aperture 166 on guide pin 168. An inner threaded counterbore 170 is provided in the lower end of body 150 for threadingly receiving a spline nut 172 having a plurality of internal splines 174 forming longitudinal slots therebetween. Internal splines 174 are spaced such that the longitudinal slots receive splines 122 on release nut 110, previously described.

Piston 152 includes an upper counterbore 176 adapted for receiving the reduced diameter lower end of body 150. A shear pin 178 extends between piston 152 and body 150. Piston 152 further includes an enlarged diameter portion 182 projecting radially outward. Enlarged diameter portion 182 includes a plurality of apertures or pockets 184 housing individual retractable setting dogs 180. Retractable setting dogs 180 each include a pair of arcuate flanges 185 which engage a retainer ring 186 extending around enlarged diameter portion 182 for maintaining retractable dogs 180 within pockets 184. Setting dogs 180 are spring biased radially outward by springs 188. Piston 152 further includes an enlarged inner diameter portion 191 which includes an inwardly projecting radial boss 192 housing a sealing member 194 which seals with lower mandrel 130 in its uppermost position best shown in FIG. 4B as hereinafter described. Enlarged inner diameter portion 191, boss 192 and the lower terminal end of body 150 form an annular cylinder or chamber 190 upon lower mandrel 130 being raised to its upper position shown in FIG. 4B. The lower terminal end 196 of piston 152 has a reduced outer diameter 197 for receiving a centralizer ring 201 which is maintained on reduced diameter portion 197 by a snap ring 198. Centralizer ring 201 contacts the inside diameter of tubular member 62 to centralize packer setting tool 60 within liner packer 40. Piston 152 is provided at its lower end with an inwardly facing annular channel 199 which houses a ratchet ring 200 with inner ratchet teeth 202 adapted to engage ratchet teeth 142 on sleeve 140.

Liner Hanger

Referring now to FIG. 2A, liner hanger 30 includes a tubular member 208 having a plurality of slips 210 mounted within slip slots 212 disposed around liner hanger 30. The upper end of slip slots 212 and the upper end of slips 210 have inclined camming surfaces at 214 for camming slips 210 radially outward and into engagement with outer casing 14. A threaded box 216 with left-hand internal threads is provided at the upper end of liner hanger 30 for receiving a running nut 220. Running nut 220 has outer left-hand threads which threadingly engage the inner left-hand threads of box 216. Nut 220 also includes a plurality of longitudinal apertures 219 for the passage of fluids. Running nut 220 includes a plurality of splined slots on its inside diameter for receiving splines 223 located on the lower end of kelly 228 at the upper end of pocket slip setting tool 50 as hereinafter described. Further details of the liner hanger 30 are disclosed in U.S. Pat. No. 4,712,614, incorporated herein by reference.

Pocket Slip Setting Tool

The pocket slip setting tool 50 includes an inner tubular mandrel 222 which includes a threaded pin at its upper end for threaded engagement to the threaded box on the lower end of kelly 228. Kelly 228 is threadingly connected to the lower end of pipe string 22 shown in FIG. 1. A bearing housing 234 is received over kelly 228 and is attached thereto to form a junk cover for liner hanger 30. Housing 234 prevents deleterious material from falling into the upper end of liner hanger 30 and includes a plurality of ports 236 for the passage of fluids. The lower end of kelly 228 is in the form of a hex 232 having splines 223 which form slots for receiving the internal splines on running release nut 220. The lower end of kelly 228 includes upwardly facing stop shoulders 221 for abutting engagement with the lower end of running nut 220.

A unitary hydraulic-mechanical actuator assembly 240 is disposed around inner mandrel 222 below kelly 228. Actuator assembly 240 includes an actuator sleeve piston 224 slidably mounted on the exterior of inner mandrel 222. A dog housing 227 is threaded to the lower end of piston 224 and includes a plurality of dogs 230 projecting through apertures 231. A shear member 229 is threaded onto the lower end of housing 227. The piston 224 has an inwardly facing annular flange 225 forming a hydraulic cylinder chamber 235 with an annular boss 237 which projects radially outward from inner mandrel 222. Seals are provided on flange 225 and boss 237 for sealing chamber 235. Ports 238 provide fluid access from the flowbore 54 of mandrel 222 to the chamber 235. A stop ring 239 is provided on mandrel 222 within chamber 235 to compress a spring 219 between flange 225 and stop ring 239. The shear member 229 includes shear screws 242 threaded into inner mandrel 222. An inwardly directed annular channel 243 is provided in the lower end of shear member 229 for receiving a split latch ring 245 having internal ratchet teeth 241. A dog release groove 244 is disposed around mandrel 222 such that upon split ratchet ring 245 engaging a lower ratchet ring 246, mounted around the lower end of inner mandrel 222, annular release groove 244 is positioned beneath dogs 230. Further details of the hanger setting tool 50 are disclosed in U.S. Pat. No. 4,712,614, incorporated herein by reference.

Setting the Liner Hanger

Referring now to FIG. 1, the liner assembly 10 is lowered into the bore 56 formed by outer casing 14 and borehole 20. As shown in FIG. 1, the top of liner assembly 10 is a distance A above the bottom of outer casing 14. The lower end of liner 26 is a distance B above the borehole bottom 24. Distance A, typically in the range of 200 to 500 feet, is greater than distance B.

Referring now to FIGS. 1 and 2A–C, in the operation of the hanger setting tool 50, the hanger slips 210 can be set either mechanically or hydraulically. For hydraulic setting, the liner 26, liner hanger 30, setting tool 50, and pipe string 22 are lowered and located in the borehole 20 and casing 14 at a depth where the liner hanger 30 is to be set. The sealing ball or plug 35 is dropped through the pipe string 22 to ball catcher 52 which is releasably mounted in landing collar 32. At that time, the borehole of setting tools 50, 60, liner 26 and borehole 54 are sealed to prevent any further downward fluid movement. By pressuring up on the fluid in the pipe string 22, pressure in the annular chamber 235 first shears shear screws 242 and then the hydraulic force on the piston 224 (as well as the spring force), moves piston 224 upwardly on inner mandrel 222 causing the dogs 230 to move upwardly while engaging the lower end 211 of slips 210. The shear pin 215 for slips 210 is sheared and the slips 210 are moved outwardly along the inclined surfaces 214 causing slips 210 to engage well casing 14 for supporting the weight of liner 26. The pipe string 22 is then lowered and, upon right hand rotation of the pipe string 22, the running nut 220 unthreads from the box 216 due to their left-hand threads. At the same time, piston 224 unscrews from dog housing 227 so that inner mandrel 222 can be disengaged from liner hanger 30. Upon moving the pipe string 22 upwardly, the ratchet ring 246 on the lower end of inner mandrel 222 is received by and engages the split ratchet ring 245. Further, the release groove 244 is located beneath the dogs 230 so that the dogs 230 are moved inwardly and released from slips 210. The entire setting tool assembly 50, 60 is then lifted off liner hanger 30.

Alternatively, to set the liner hanger 30 mechanically, liner 26 is lowered in the well until it engages the bottom 24 of the well bore 20 to ensure that the piston 224 can be rotated relative to the liner hanger 30. By rotating the pipe string 22, shear pin 242 is sheared and spring 219 moves the piston 224 upwardly. The spring force of the spring 219 causes the dogs 230 to engage the lower end 211 of slips 210 and shears shear pins 215 and releases slips 210. Upon lifting the pipe string 22, the stop flange 221 below the running nut 220 contracts the nut 220. The pipe string 22 then is raised to move liner 26 to the desired location from well bottom 24 while slips 210 drag along the well bore surface and are being pushed outwardly by the spring force only. At the desired location for hanging liner 26, the pipe string 22 is lowered thus setting the slips 210 and hanging the liner 26 in outer casing 14. Next, the pipe string 22 is slacked-off so that load is removed from nut 220 to allow rotation of pipe string 22 to release the nut 220 and the hanger setting tool 50 from the liner hanger 30. At this time, inner mandrel 222 is raised so that the ratchet ring 246 is received by and engages split ratchet ring 245 and release groove 244 is aligned with and releases dogs 230 from slips 210.

The Cementing, Operation

Referring again to FIGS. 1 and 2A–C, to begin the cementing operation, the flowbore 54 is opened by pressuring down flowbore 54 (formed by pipe string 22 and setting tools 50, 60) to shear ball catch 52 from landing collar 32 and release the ball catch 52 with sealing plug 35. This allows fluid flow around the lower end of liner 26 and up the annulus 56 formed between liner 26 and borehole 20 and between pipe string 22 and outer casing 14. Cement is then pumped down flowbore 54 through the one-way valve in flow collar 34 and the one way valve in shoe 36 and around the lower end of liner 26. The cement then flows up the annulus 56 adjacent borehole 20. As the cement approaches the liner hanger 30, a solid nose plug (not shown) with wipers is pumped down on top of the cement column and latches with wiper plug 44. The wipers on the plug wipe the cement from the inside diameter of pipe string 22. The wiper plug 44 is then run through the liner 26 wiping the cement off the inside diameter of liner 26. This provides for a smooth clean inside diameter.

As the cement flows up that portion of the annulus 56 between liner 26 and borehole 20, the cement reaches the liner packer 40. The liner packer 40 has not yet been set. The cement is allowed to not only pass through that portion of the annulus 56 between the liner packer 40 and outer casing 14 but also through cement by-pass port 80 and up the annular area 81 between packer setting assembly 100 and tubular member 62. Annular area 81 also extends between the pocket slip setting tool 50 and liner hanger 30. When wiper plug 44 lands and latches into landing collar 32, the cementing operation is complete. Running nut 220 includes ports 219 which also allow the cement, if necessary, to pass through junk cover 234 and out ports 236 and back into that portion of the annulus 56 between pipe string 22 and outer casing 14. Allowing the cement to flow through by-pass ports 80 and up annular area 81 inside liner packer 40 as well as up annulus 56 around liner packer 40 avoids any restriction to cement flow, as distinguished from the prior art.

Setting the Liner Packer

As soon as the cementing operation is completed, the liner packer 40 is set by the packer setting tool 60. FIGS. 2A–C and 4A illustrate the positioning of the packer setting tool 60 with respect to the liner packer 40 upon completing the cementing operation.

Figure 4A:
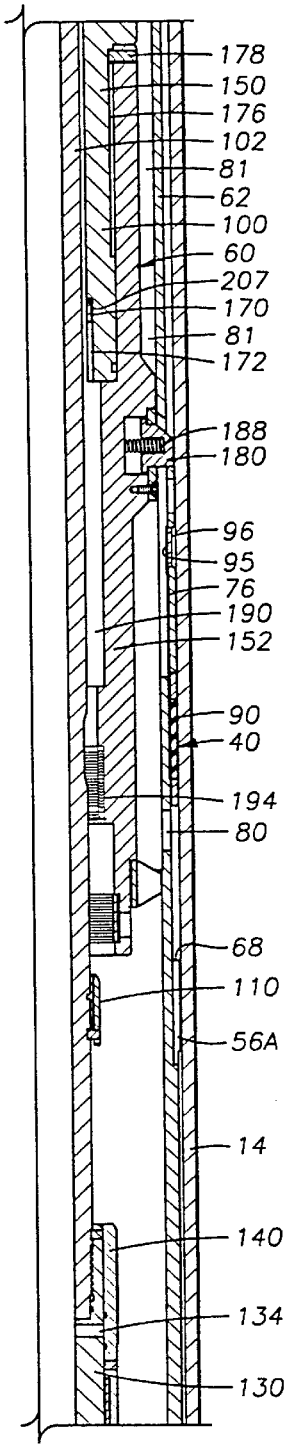
FIG. 4A is a partial cross-sectional elevation view of the liner packer and packer setting tool in the running position.
Figure 4B:
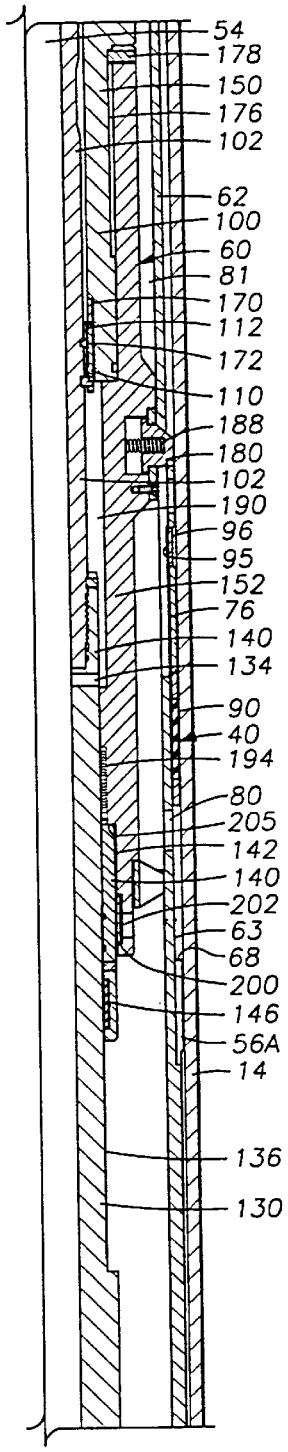
FIG. 4B is a partial cross-sectional elevation view of the liner packer with the mandrel of the packer setting tool in engagement with the packer actuator assembly.

Referring now to FIG. 4B, the lower mandrel 130 of packer setting tool 60 is raised by pipe string 22. As sleeve 140 is received within the lower end of liner packer assembly 100, the upper terminal end of sleeve 140 engages downwardly facing shoulder 205 causing sleeve 140 to become stationary and move downwardly on lower mandrel 130 as the upward movement of sleeve 140 is halted by shoulder 205 and lower mandrel 130 continues its upward movement. In this lower position, lower ratchet ring 146 engages the external ratchet threads 136 on the exterior of lower mandrel 130. Simultaneously, sleeve 140 is received by upper ratchet ring 200 causing ratchet teeth 202 to engage ratchet threads 142 on sleeve 140. Also, the spline nut 172 on liner packer assembly 100 receives and abuts release nut 110 on mandrel 130. The beveled noses 124, 126 (See FIG. 3) on the splines 122 of release nut 110 guide splines 122 into the spline slots formed between the splines of spline nut 172.

Figure 4C:
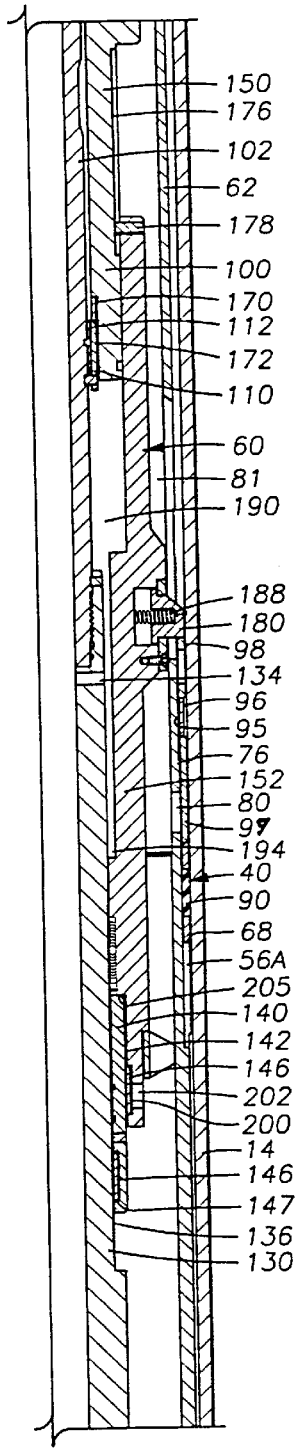
FIG. 4C is a partial cross-sectional elevation view of the liner packer which has been set hydraulically.

Referring now to FIG. 4C, the liner packer 40 may be set either mechanically or hydraulically or hydraulically and mechanically. To set the liner packer 40 hydraulically, the packer setting tool 60 is raised to its uppermost position as shown in FIG. 4B. In this uppermost position, hydraulic chamber 190 is formed by the sealing engagement of sealing member 194 with lower mandrel 130. Previously, as shown in FIG. 4A, chamber 190 is open. Further, hydraulic ports 134 register with hydraulic chamber 190. Upon applying hydraulic pressure down the flowbore 54 of pipe string 22, hydraulic pressure is applied to piston 152 causing piston 152 to move downwardly within the cylinder 190 with respect to mandrel 102 and liner packer 40. The retractable setting dogs 180 bear against the upper annular terminal end of spacer and retainer ring 98 shifting ratchet ring 96, spacer ring 99, and packer element 90 downward over the reduced diameter portion 63 of tubular member 62 until the lower terminal end of packing element 90 engages upwardly facing annular shoulder 68. The packing element 90 completely passes over by-pass ports 80. Packing element 90 is then compressed and radially energized into sealing engagement with the inside diameter of outer casing 14. Further, the teeth 95 on ratchet ring 96 engage the teeth 76 around reduced diameter portion 63 so as to maintain packing element 90 in the energized position shown in FIG. 4C.

Figure 4D:
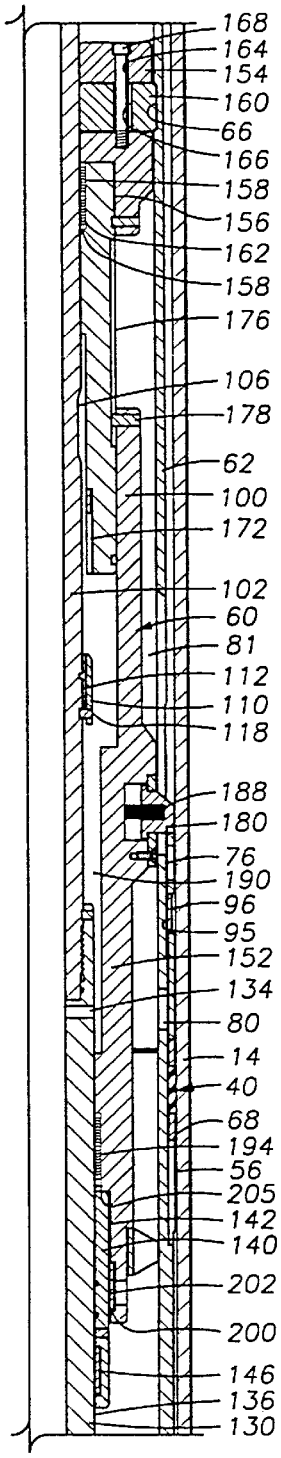
FIG. 4D is a partial cross-sectional elevation view of the liner packer and packer setting tool with the packer set mechanically.

Alternatively, the liner packer 40 may be set mechanically as shown in FIG. 4D. Since the lower ratchet ring 146 has engaged ratchet threads 136 and the outer ratchet threads 142 on sleeve 140 have engaged ratchet thread 202 on ratchet ring 200, weight may be placed on the pipe string 22 causing the respective ratchet threads to transmit the load from the inner mandrel 102 to the packer setting assembly 100. Thus, the weight is transferred to retractable setting dogs 180 by means of piston 152 setting liner packer 40 in the sequence previously described.

Further, it should be appreciated that the liner packer 40 may be set hydraulically and mechanically. The liner packer 40 may be set hydraulically as previously described with respect to FIG. 4C and then further set mechanically as described with respect to FIG. 4D by placing weight on the pipe string 22 which is transferred to retractable setting dogs 180 to further compress and energize packing elements 90 on liner packer 40 into engagement with outer casing 14.

Figure 4E:
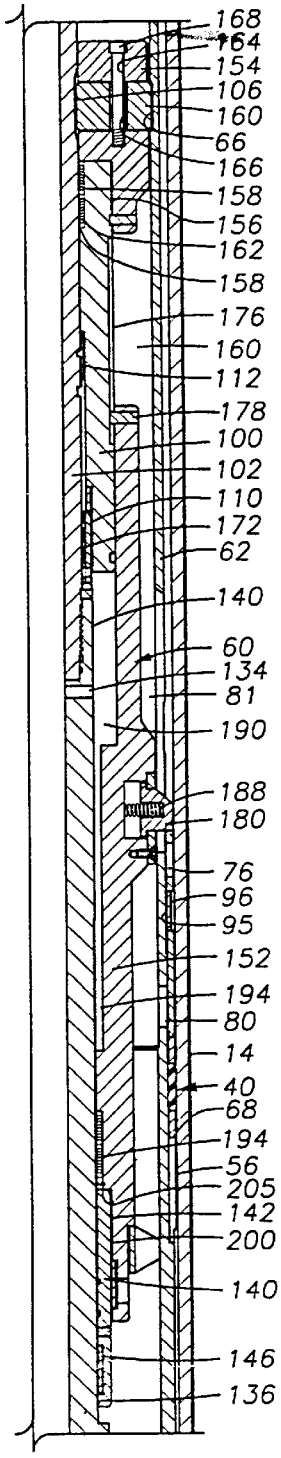
FIG. 4E is a partial cross-sectional elevation view of the packer setting tool in the release position.

Referring now to FIG. 4E, to release packer setting tool 60, pipe string 22 is rotated. During the rotation, the light shear screw 118 keeps shear release ring 112 rotating with mandrel 102 thereby causing it to rotate from underneath spline release nut 110. Thus, upon rotation, the spline release nut 110 is rotated off the threaded split ring 112. Upon pickup of inner mandrel 102, retractable setting dogs 180 are biased inwardly against springs 188. Upon raising inner mandrel 102, annular groove 106 is positioned beneath latches 160 allowing them to be cammed inwardly upon further upward movement of mandrel 102.

Figure 4F:
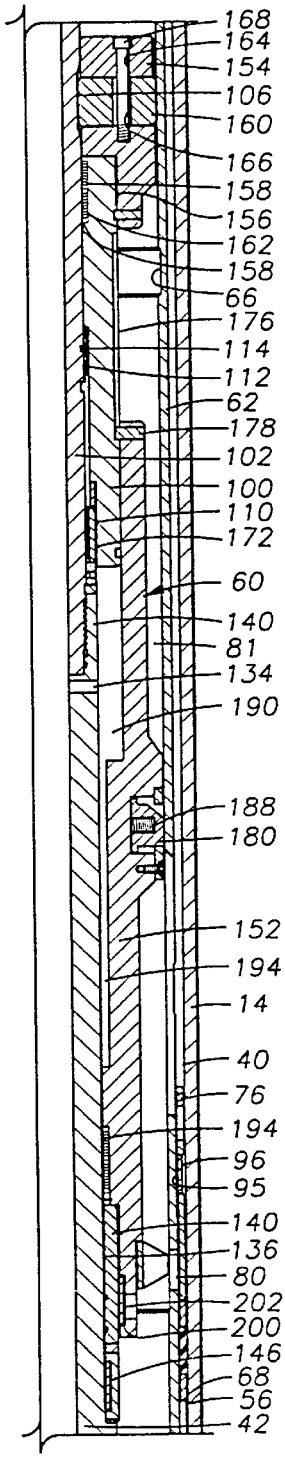
FIG. 4F is a partial cross-sectional elevation view of the packer and packer setting tool with the packer setting tool in the retrieving position.

The packer setting tool 60 may then be retrieved from the hole as shown in FIG. 4F.

The packer setting tool 60 further includes an emergency shear release. The inwardly directed flange member 114 on threaded split ring 112 located in groove 116 of mandrel 102 acts as a shear ring. Upward movement of mandrel 102 shears flange member 114 allowing annular groove 106 to be positioned beneath latches 160. The threaded split ring 112 in the lower end 102 of packer setting tool 60 is also a shear ring. The flange 114 on the threaded split ring 112 may be sheared allowing everything to be removed from the well.

While a preferred embodiment of the invention has been shown and described, modifications thereof can be made by one skilled in the art without departing from the spirit of the invention.

We claim:

1. An apparatus for setting a liner packer comprising:

a tubular member having a flowbore;

an actuator member mounted on said tubular member;

said actuator member having a contact member engaging the liner packer and setting the liner packer upon movement of said contact member with respect to the liner packer;

said actuator member being sealed from fluid pressure within the flowbore until the liner packer is to be set; and said contact member being optionally actuable either mechanically by moving the tubular member or hydraulically by pressuring through the flowbore to set the liner packer.

2. An apparatus for setting a liner packer comprising:

a tubular member having a flowbore;

an actuator member mounted on said tubular member;

said actuator member having a contact member engaging the liner packer and setting the liner packer upon movement of said contact member with respect to the liner packer;

said actuator member being sealed from fluid pressure within the flowbore until the liner packer is to be set; and said contact member being hydraulically actuable by pressuring through the flowbore and mechanically actuable by moving the tubular member to set the liner packer.

3. An apparatus for setting a liner packer within a cased borehole comprising:

a tubular body having a flowbore and an aperture through a wall thereof;

a closure member on said tubular body and having an open and a closed position to open and close said aperture;

an actuator member mounted on said body and releasably supported by the packer;

said actuator member including a compressor member engaging the liner packer and adapted to compress a packer element into engagement with the cased borehole; and said compressor member being sealed from the flowbore in said closed position and being actuable to compress the packer element in said open position.

4. The aperture of claim 3 wherein said closure member includes a movable member slidably mounted on said body and movable from said closed position to said open position.

5. The apparatus of claim 3 wherein said actuator member includes locking members having a first position locking the actuator member to the liner packer and a second position unlocking the actuator member from the liner packer, said locking members being non-rotatably movable between said first and second positions.

6. An apparatus for setting a liner packer within a cased borehole comprising:

a tubular body having a flowbore and an aperture through a wall thereof;

a closure member on said tubular body and having an open and a closed position to open and close said aperture;

an actuator member mounted on said body and releasably supported by the packer;

a compressor member engaging the liner packer and adapted to compress a packer element into engagement with the cased borehole;

said compressor member being sealed from the flowbore in said closed position and being actuatable to compress the packer element in said open position; and said actuator member including retractable members having an outer position engaging the liner packer and an inner position disengaging the liner packer.

7. The apparatus of claim 6 wherein said body includes a release groove allowing said retractable members to retract from said outer to said inner position.

8. An apparatus for setting a liner packer within a cased borehole comprising:

a tubular body having a flowbore and an aperture through a wall thereof;

a closure member on said tubular body and having an open and a closed position to open and close said aperture;

an actuator member mounted on said body and releasably supported by the packer;

a compressor member engaging the liner packer and adapted to compress a packer element into engagement with the cased borehole;

said compressor member being sealed from the flowbore in said closed position and being actuatable to compress the packer element in said open position; and said actuator member including a stationary portion on which is movably mounted said compressor member, said stationary portion and compressor member forming a pressure chamber adapted to communicate with said aperture when said closure member is in said open position whereby the flowbore may be pressurized to thereby pressurize said cylinder and move said compressor member for compressing the liner packer.

9. The apparatus of claim 8 wherein said compressor member includes outwardly biased members adapted to engage the liner packer.

10. The apparatus of claim 3 further including a release member having a disengaged position and an engaged position whereby at said engaged position, said body may be moved upwardly without rotation with respect to said actuator member to release said actuator member from the liner packer.

11. An apparatus for setting a liner packer within a cased borehole comprising:

a tubular body having a flowbore and an aperture through a wall thereof;

a closure member on said tubular body and having an open and a closed position to open and close said aperture;

an actuator member mounted on said body and releasably supported by the packer;

a compressor member engaging the liner packer and adapted to compress a packer element into engagement with the cased borehole;

said compressor member being sealed from the flowbore in said closed position and being actuatable to compress the packer element in said open position;

a release member having a disengaged position and an engaged position whereby at said engaged position, said body may be moved with respect to said actuator member to release said actuator member from the liner packer; and a shear member connecting said body to said actuator member until said shear member is sheared allowing said release member to be moved to said open position.

12. The apparatus of claim 3 further including a connector member having a first position connecting said actuator member to the liner packer and a second position connecting said actuator member to said tubular body.

13. An apparatus for setting a liner packer within a cased borehole comprising:

a tubular body having a flowbore and an aperture through a wall thereof;

a closure member on said tubular body and having an open and a closed position to open and close said aperture;

an actuator member mounted on said body and releasably supported by the packer;

a compressor member engaging the liner packer and adapted to compress a packer element into engagement with the cased borehole;

said compressor member being sealed from the flowbore in said closed position and being actuatable to compress the packer element in said open position;

a connector member for connecting said tubular body and said actuator member and having an unconnected position where said body is not connected to said actuator member and a connected position where said body and actuator member are connected;

wherein in said connected position, said body and thus said actuator member are moved with respect to the liner packer for setting the liner packer.

14. An apparatus for setting a liner packer comprising:

a tubular member having a flowbore;

an actuator member mounted on said tubular member;

said actuator member having a contact member engaging the liner packer and setting the liner packer upon movement of said contact member with respect to the liner packer;

said tubular member having a first position where no cylinder is formed for said actuator member and a second position where said tubular member forms a cylinder for said actuator member; and an aperture in said tubular member allowing hydraulic pressure to be applied to said actuator member in said cylinder for hydraulically setting the liner packer.

15. The apparatus of claim 14 wherein said actuator member includes a seal sealing with said tubular member in said second position.

16. The apparatus of claim 14 wherein said tubular member includes a movable member opening the aperture in said tubular member in said second position.

* * * * *